US005181348A

United States Patent [19]

Roemmele et al.

[11] Patent Number: 5,181,348

[45] Date of Patent: Jan. 26, 1993

[54] ABRASIVE CLEANING APPARATUS

[75] Inventors: Carl F. Roemmele, Leawood; Donald F. Meister, Overland Park, both of Kans.

[73] Assignee: Target Products, Inc., Kansas City, Mo.

[21] Appl. No.: 680,770

[22] Filed: Apr. 5, 1991

[51] Int. Cl.[5] ..... B24C 3/00

[52] U.S. Cl. ..... 51/410; 51/428; 51/429

[58] Field of Search ..... 51/410, 424, 425, 426, 51/428, 429, 436

[56] References Cited

U.S. PATENT DOCUMENTS

| | | | |
|---|---|---|---|
| Re. 30,289 | 6/1980 | Hockeft | 51/429 |
| 1,829,599 | 10/1931 | McCrery . | |
| 2,483,176 | 9/1949 | Bishop et al. . | |
| 2,597,434 | 5/1952 | Bishop et al. . | |
| 2,628,456 | 2/1953 | Berg . | |
| 2,684,558 | 7/1954 | Harris et al. | 51/429 |
| 2,763,965 | 9/1956 | Stokes | 51/429 |
| 2,766,557 | 10/1956 | Pollard . | |
| 2,770,924 | 11/1956 | Mead et al. . | |
| 3,517,461 | 6/1970 | Baldwin et al. . | |
| 3,581,441 | 6/1971 | Hulbert, Jr. | 51/439 |
| 4,045,915 | 9/1977 | Gilbert et al. . | |
| 4,233,785 | 11/1980 | Abell | 51/439 |
| 4,408,419 | 10/1983 | Appling | 51/429 |
| 4,646,480 | 3/1987 | Williams . | |
| 5,052,155 | 10/1991 | Blacka et al. | 51/310 |

*Primary Examiner*—M. Rachuba

*Attorney, Agent, or Firm*—Sixbey, Friedman, Leedom & Ferguson

[57] ABSTRACT

The abrasive cleaning device operates to direct streams of abrasive particles from a plurality of nozzles against a surface to be cleaned. The nozzles are recessed in a nozzle chamber and each receives a separate stream of abrasive particles from a divider unit. The divider unit receives a single stream of compressed air and abrasive particles and a supply source and separates the abrasive particles from the compressed air. The divider unit then divides the compressed air into a plurality of streams of equal pressure, and adds an equal amount of abrasive particles to each stream. A vacuum source creates a vacuum in an abrasive particle reclamation unit and in vacuum chambers connected to the abrasive particle reclamation unit. The vacuum chambers extend on each side of the nozzle chamber but are separate therefrom. Abrasive particles and debris from the surface to be cleaned pass through the vacuum chambers to the abrasive particle reclamation unit where the debris is separated from the abrasive particles. Abrasive particles collected in the abrasive particle reclamation unit are conveyed by an air stream to a particle supply unit.

24 Claims, 3 Drawing Sheets

ABRASIVE CLEANING APPARATUS

TECHNICAL FIELD

The present invention relates to pressurized abrasive cleaning devices generally, and more particularly to an abrasive cleaning device adapted to lightly abrade a surface by means of an even distribution of air and abrasive media through a plurality of separate nozzles.

BACKGROUND OF THE INVENTION

Sandblasting devices for directing a stream of abrasive particles under pressure against a surface have been known for a number of years. Conventionally, such devices operate to entrain sand or a similar abrasive in a stream of air under pressure which is then ejected from a nozzle and directed against a surface to be cleaned or abraded. Spent abrasive particles and debris are then withdrawn by vacuum and returned to a collection and recycling assembly. The abrasive material is separated from the debris and recycled for further use. Examples of such sandblasting systems are illustrated by U.S. Pat. Nos. 2,483,176 and 2,597,434 to L. H. Bishop et al, 2,766,557 to G.M. Pollard, 2,770,924 to W.H. Mead et al, and 4,045,915 to N.J. Gilbert et al.

As illustrated by the cited patents, most sandblasting devices involve the use of a single nozzle positioned within a shroud or hood for directing abrasive material against a surface, but some sandblasting assemblies known to the prior art have incorporated a plurality of material directing nozzles. For example, U.S. Pat. Nos. 1,829,599 to H.E. McCrery and 3,517,416 to B.E. Baldwin et al illustrate multiple nozzle units wherein abrasive material provided by gravity from a storage reservoir is distributed to the input ends of a plurality of conduits leading to output nozzle units. U.S. Pat. No. 2,628,456 to R. R. Berg illustrates a sandblasting device wherein sand entrained in a stream of air is fed to a divider which splits the stream into branches which are fed through separate hoses to a plurality of nozzles. These known multiple nozzle units all require the use of a plurality of separate input conduits leading to the output nozzles for the air and abrasion material, thereby making multiple nozzle devices bulky and difficult to manipulate. More importantly, however, is the fact that even metering or distribution of air and abrasive media flow through the separate nozzles does not occur with prior multiple nozzle units.

For sandblasting, uniform distribution of air and sand to a plurality of nozzles is normally not required, as it is not imperative to maintain the integrity of the surface being abraded. For many applications, however, where the surface integrity must be maintained, soft cleaning of a sensitive surface is desirable. For example, the removal of a wax build-up on a vinyl tile floor requires that the wax be removed while the integrity of the soft vinyl is maintained, and often chemical cleaning has been the only effective way to clean soft surfaces without damage. In instances where soft cleaning with abrasives is used, the necessity to accurately control both the pressure and the content of the abrasive particle stream has led to the use of single nozzle units where such control can be maintained. Such a unit is illustrated by U.S. Pat. No. 4,646,480 to R.F. Williams. The rapid cleaning of a large area is severely inhibited by use of a single nozzle but uneven flow through multiple nozzles will at best, result in an unevenly cleaned surface showing marks caused by abrasive material impacting from different nozzles.

DISCLOSURE OF THE INVENTION

A primary object of the present invention is to provide a novel and improved abrasive cleaning system which employs a plurality of nozzles to direct a pressurized flow of abrasive media in an even pattern onto a surface to be cleaned.

Another object of the present invention is to provide a novel and improved abrasive cleaning system which employs a plurality of nozzles which emit streams of abrasive of substantially equal pressure and which contain substantially equal amounts of abrasive material.

A further object of the present invention is to provide a novel and improved abrasive cleaning system wherein a single supply of abrasive media in an airstream is provided from a supply source to a portable nozzle carrier. The abrasive media is separated from the airstream in a divider unit which then divides the separated airstream into a plurality of streams of substantially equal pressure. The divider unit provides substantially equal amounts of abrasive material to each of the plurality of streams, and each stream is then directed to a separate nozzle.

Yet another object of the present invention is to provide a novel and improved abrasive cleaning system which includes a portable nozzle carrier unit connected to a vacuum and abrasive reclamation system as well as to a source of pressurized air and abrasive material. The vacuum and abrasive reclamation system draws abrasive material and debris from a surface cleaned by the portable nozzle carrier and separates the debris from the abrasive material in a reclamation unit which collects the separated abrasive. The source of pressurized air and abrasive provides an air stream to the portable nozzle carrier through a single conduit, and an abrasive supply unit supplies abrasive material to the air stream. An air stream is also provided to the reclamation unit to transfer abrasive material collected thereby to the abrasive supply unit.

A still further object of the present invention is to provide a novel and improved abrasive cleaning system which includes a portable nozzle carrier unit having a plurality of nozzles to direct abrasive particles against a surface to be cleaned. The nozzles are recessed in a nozzle chamber and each receives a separate stream of abrasive particles from a divider unit mounted on the nozzle carrier unit. The divider unit receives a single stream of compressed air and abrasive particles from a remote supply source and separates the abrasive particles from the compressed air. The divider unit then divides the compressed air into a plurality of separate streams of substantially equal pressure, and adds a substantially, equal amount of abrasive particles to each stream. A vacuum source creates a vacuum in an abrasive particle reclamation unit and in vacuum chambers connected to the abrasive particle reclamation unit. The vacuum chambers extend on each side of the nozzle chamber, but are separate therefrom, and both the vacuum and nozzle chambers open in close proximity to the surface to be cleaned. Abrasive particles and debris from the surface to be cleaned pass through the vacuum chambers to the abrasive particle reclamation unit where the debris is separated from the abrasive particles. The abrasive particles collected in the abrasive particle reclamation unit are then selectively conveyed by an airstream to a particle supply unit which mixes particles in the airstream to the divider unit.

BEST MODE FOR CARRYING OUT THE INVENTION

Figure 1:
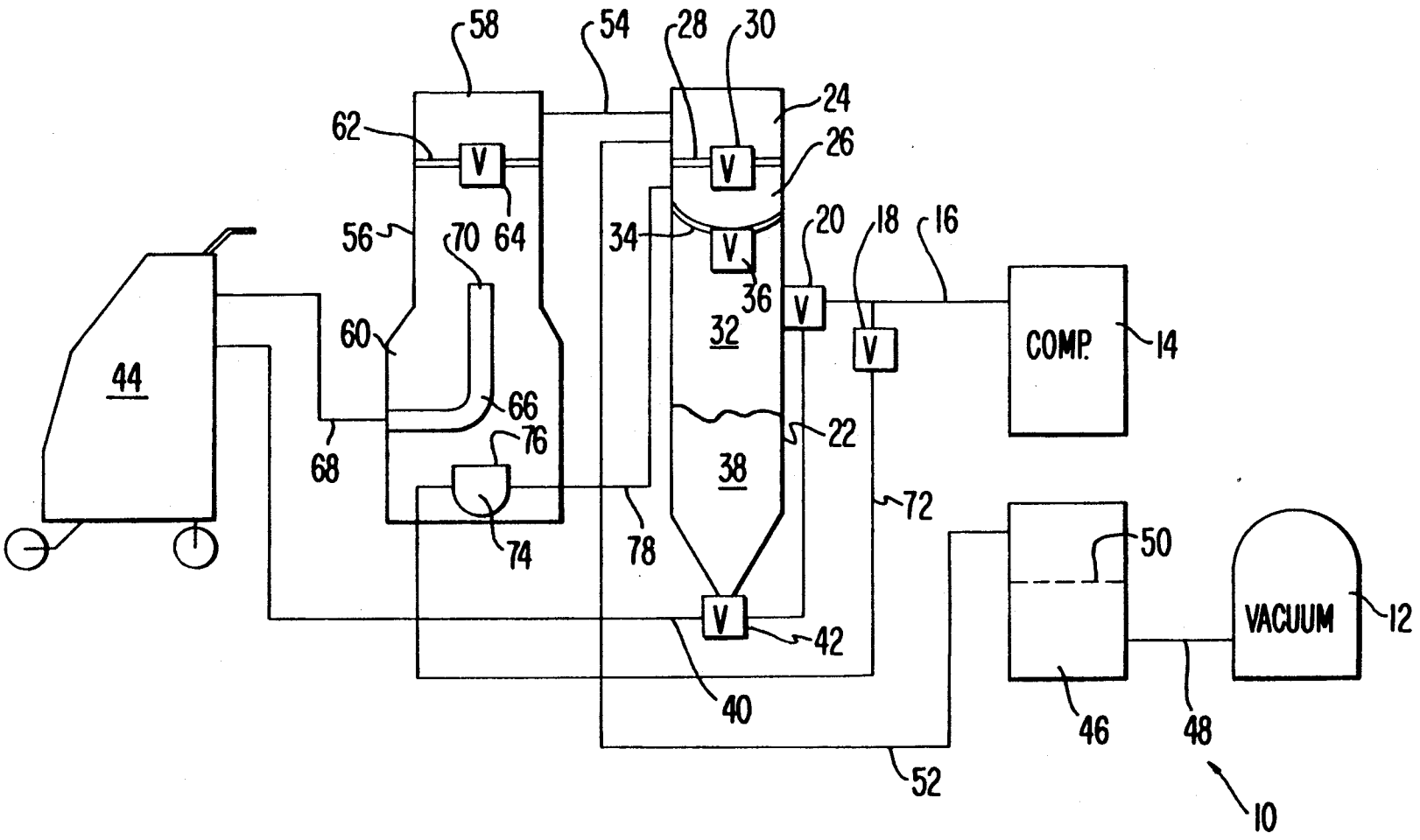
FIG. 1 is a diagrammatic illustration of the abrasive cleaning system of the present invention.

Referring now to FIG. 1, the abrasive cleaning apparatus of the present invention indicated generally at 10 includes a vacuum source 12 and a compressor 14 for providing a source of compressed air. The compressor 14 provides a stream of compressed air by means of an air conduit 16 and valves 18 and 20 to a transfer receiver separator 22. This transfer receiver separator includes an upper section 24 separated from a media receiver section 26 by means of a dividing wall 28 which contains a valve 30. Similarly, the media receiver section 26 is separated from a pressure vessel 32 by means of a dividing wall 34 containing a valve 36. A dry media 38 consisting of abrasive particles is contained in the bottom of the pressure vessel 32, and these particles are mixed with compressed air in an air conduit 40 by means of a valve 42 mounted at the bottom of the pressure vessel 32. Abrasive particles in a stream of compressed air are conveyed by the air conduit 40 to a portable cleaner unit 44.

The vacuum source 12 draws a vacuum through a dust collector 46 by means of a vacuum conduit 48. Dust collector 46 is provided with a suitable filtering screen 50 which will remove dust from the vacuum stream passing through the dust collector to the vacuum source 12 and will permit the separated dust to drop to the bottom of the dust collector. The dust collector is connected by means of a vacuum conduit 52 to the upper section 24 of the transfer receiver separator 22, and the upper section 24 is connected by means of a vacuum conduit 54 to a classifier unit 56. This classifier unit has an upper section 58 divided from a lower section 60 by means of a dividing wall 62 which contains a valve 64. Spaced above the bottom of the classifier unit 56 is a classifier ejector tube 66 mounted on the sidewall of the lower section 60 which connects with a vacuum conduit 68 leading to the portable cleaner unit 44. The classifier ejector tube extends from the sidewall of the lower section 60 into the lower section and then curves upwardly to an open end 70. When the valve 64 is opened, the vacuum source 12 draws a vacuum through the vacuum conduit 68, the classifier ejector tube 66, the vacuum conduit 54, the upper section 24, the vacuum conduit 52, the dust collector 46, and the vacuum conduit 48. Thus, a vacuum path is established from the vacuum source 12 to the portable cleaner unit 44.

Figure 2:
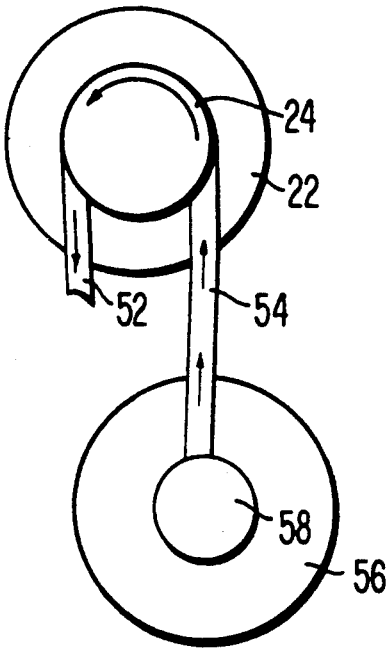
FIG. 2 is a plan view of the transfer receiver separator and classifier unit of FIG. 1.

During normal operation of the abrasive cleaning apparatus. The compressor 14 provides compressed air through the air conduit 16, and valve 20 to pressurize the pressure vessel 32. The valve 18 in this mode of operation, prevents pressurized air from passing along an air conduit 72 which leads to the classifier unit 56. The valve 20 operates to provide air both to the pressure vessel 32 as well as to the air conduit 40 and valve 42. Both the valves 30 and 36 are closed so that the pressure vessel becomes pressurized and dry media 38 passes through the valve 42 into the air conduit 40. This dry abrasive media is then directed in an air stream to the portable cleaner unit 44, and in a manner to be subsequently described, is directed against a surface to be cleaned. At the same time, since the valve 64 is open, a vacuum created in the portable cleaner unit by the vacuum conduit 68 draws a stream of abrasive particles, dust and dirt entrained in air through the vacuum conduit and the classifier ejector tube 66. As the dirt, dust and abrasive particles pass out through the open end 70 of the classifier ejector tube, the dirt and dust are drawn through the valve 64 while the heavier abrasive particles drop to the bottom of the lower section 60 of the classifier unit. The vacuum draws the dust and dirt from the upper section 58 of the classifier unit through the vacuum conduit 54 to the upper section 24 of the transfer receiver separator 22. As will be noted from FIG. 2, since the valve 30 is closed, the air and dirt will pass around the section 24 and back out through the vacuum conduit 52 to the dust collector 46. In the dust collector, the filtering screen 50 will cause dust and dirt to be cleaned from the air and deposited at the bottom of the dust collector, and cleaned air will pass through the vacuum conduit 48 to the vacuum source 12. Vacuum source 12 can constitute a conventional motor driven vacuum blower, or other known means for creating a vacuum in a system of this type.

It has been noted that abrasive media ejected from the open end 70 of the classifier ejector tube 66 falls to the bottom of the lower section 60 of the classifier unit 56. This media collects until it covers an eductor 74 mounted in the bottom of the classifier unit. The eductor 74 has an open end 76 to receive the media, and is connected by means of an air conduit 78 to the media receiver section 26 of the transfer receiver separator 22. When a sufficient amount of media collects in the classifier unit 56, the abrasive cleaning apparatus is placed in a recycle mode. In this mode, the valve 64 is closed to remove the vacuum from the lower section 60 of the classifier unit 56 and also from the portable cleaner unit 44. Similarly, the valve 42 is closed to terminate the flow of compressed air and abrasive media to the portable cleaner unit 44, while the valves 30 and 36 are open to depressurize the pressure chamber 32. Additionally, the valve 18 now directs the air stream from the compressor 14 to the air conduit 72, so that a stream of compressed air passes through the eductor 74 and into the air conduit 78. This stream of air causes abrasive media to pass through the open end 76 of the eductor and to flow in a stream through the conduit 78 into the media receiver section 26. Since the pressure vessel 32 is depressurized and the valve 36 is opened, the media now drops by gravity into the bottom of the transfer receiver separator 22. The air stream passing through the air conduit 78 is drawn upwardly through the open valve 30 and then through the vacuum conduit 52 to the dust collector 46.

Figure 4:
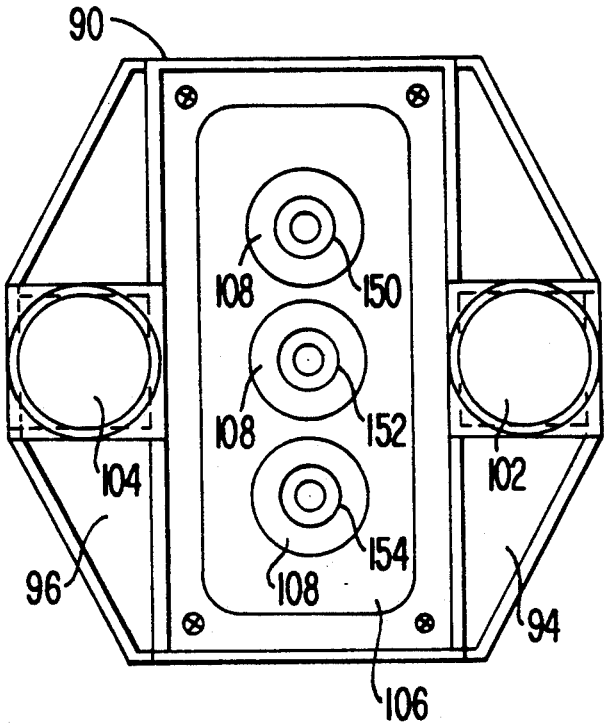
FIG. 4 is a cross-sectional view of the nozzle and vacuum chambers for the portable cleaner unit of FIG. 3.
Figure 5:
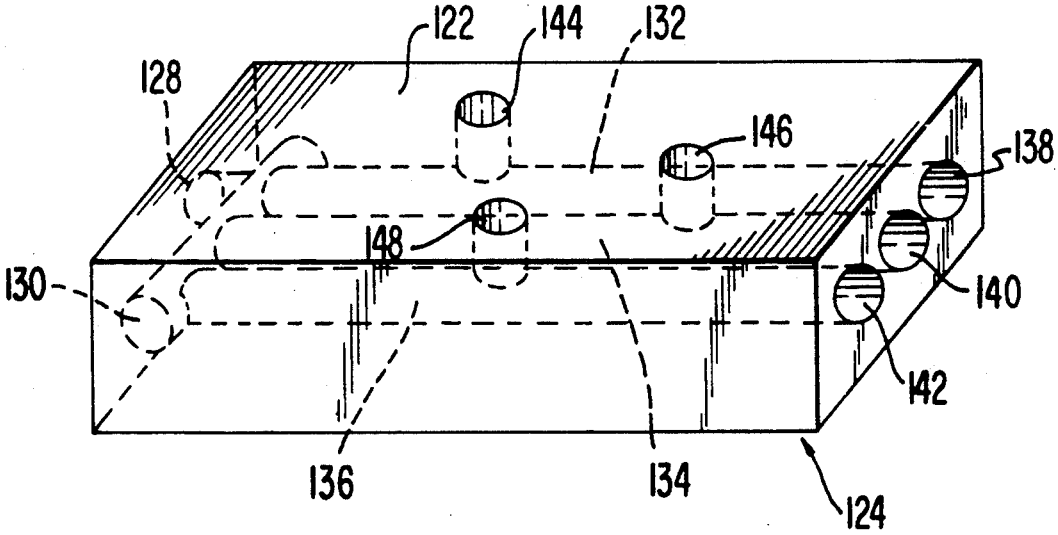
FIG. 5 is a perspective view of the manifold for the portable cleaner unit of FIG. 3.
Figure 3:
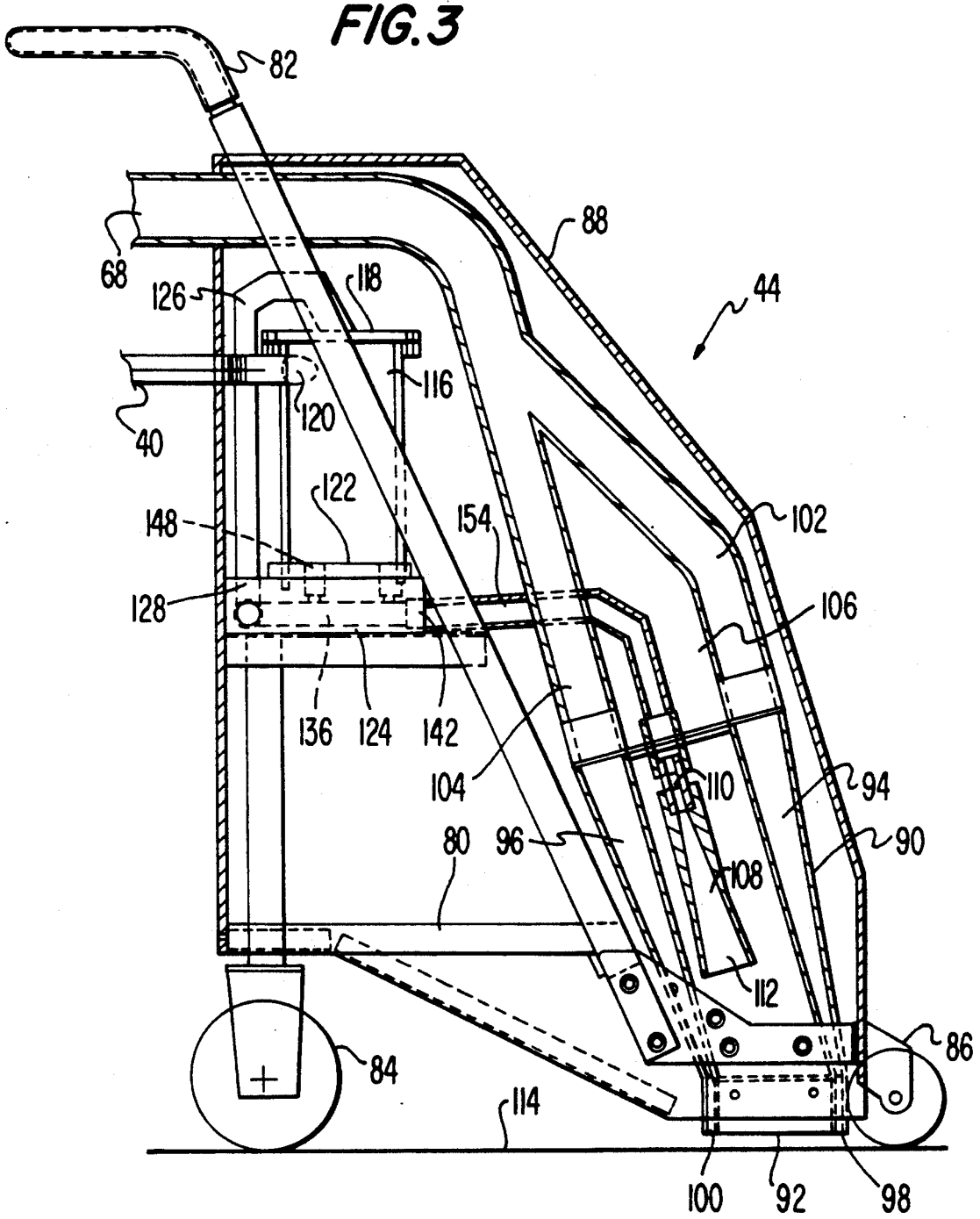
FIG. 3 is a vertical sectional view of the portable cleaner unit of FIG. 1.

Referring now to FIGS. 3-5, it will be noted that the portable cleaner unit 44 includes a frame 80 to which is attached a handle 82, rear wheel units 84 and suitable front wheel units 86. The portable cleaner unit includes an outer housing 88 mounted on the frame 80, and a shroud 90 is mounted on the frame within the housing 88 to form a nozzle chamber. This shroud has an open end 92 located behind but closely adjacent to the front wheel units 86, and abrasive material is directed from the open end of the shroud against the surface to be cleaned. The shroud is formed with a forward vacuum chamber 94 and a rear vacuum chamber 96 which extend across the front and rear edges of the shroud. The vacuum chambers 94 and 96 taper downwardly to narrow vacuum inlet slots 98 and 100, respectively, which extend across the front and rear ends of the shroud 90 on either side of the open end 92.

The vacuum conduit 68 splits within the housing 88 at the top of the shroud 90 to provide two branches 102 and 104. The branch 102 draws a vacuum on the forward vacuum chamber 94 while the branch 104 draws a vacuum on the rear vacuum chamber 96. The vacuum chambers 94 and 96 extend across the front and rear extent of a central nozzle chamber 106 formed in the shroud 90. This nozzle chamber communicates with the open end 92 of the shroud 90 and contains a plurality of abrasive projection nozzles 108. For purposes of illustration, three abrasive projection nozzles are illustrated in the drawings. but any desired number of nozzles may be mounted in the nozzle chamber 106.

Each abrasive projection nozzle includes a restricted inlet portion 110, and then the nozzle widens and tapers outwardly to a nozzle outlet 112. It will be noted that the nozzle outlets of each nozzle are spaced well back from the open end 92 of the shroud to cause the abrasive streams issuing from each nozzle to spread evenly across the shroud open end 92 and to impact evenly on an underlying surface 114 to be cleaned. The abrasive projection nozzles 108 are mounted so that in combination they project streams of abrasive material which combine to form an even stream extending across the shroud open end 92. There is a minimum degree of overlap between the individual streams of abrasive material so that the abrasive from all nozzles impacts evenly across the surface 114 and does not result in the formation of swirls or streaks. It will be noted that while the forward and rear vacuum chambers 94 and 96 extend far beyond the nozzles 108 to the vacuum inlet slots 98 and 100, the vacuum chambers do not communicate with the nozzle chamber 106 and consequently the vacuum therein does not affect the flow of abrasive from the nozzle outlets 112 to the surface 114.

A multiple nozzle unit for cleaning a substance, such as wax, from a surface, such as a vinyl floor, must provide a substantially equal flow of abrasive from each nozzle under substantially equal pressure. Otherwise, uneven cleaning or floor damage is likely to occur. It is not feasible to provide a separate abrasive supply conduit for each individual nozzle from a remote source to the portable cleaning unit 44. Not only would the plurality of conduits extending from the portable cleaning unit make the unit ponderous and difficult to control, but also it is difficult to maintain equal supplies of abrasive and air through a plurality of conduits over an extended distance. Consequently, the single supply conduit 40 supplies abrasive in a stream of compressed air under pressure to a separator unit 116 mounted on the frame 80 of the portable cleaner unit 44. This separator unit consists of a cylinder having an upper end closed by a top closure 118, and the air conduit 40 opens into the separator at an opening 120 spaced slightly below the top closure. The opening 120 is oriented to direct a stream of air and abrasive around the inner surface of the cylindrical separator, and as the heavier abrasive media spins around the inner surface of the separator, it descends and is separated from the compressed air by cyclone action. The bottom end of the separator 116 is closed by the flat upper surface 122 of a manifold 124, and the separated media descending to the bottom of the separator spreads in a substantially even manner across the flat surface 122.

In order to eliminate any air pressure differential across the media in the bottom of the separator unit 116, the separator unit is vented through the top closure 118 by a vent line 126. This vent line directs compressed air through an inlet opening 128 in the manifold 124 which communicates with a laterally extending manifold chamber 130. The manifold chamber is formed internally in the rear portion of the manifold, and distributes air to three internal, longitudinally extending air passages 132, 134 and 136. These longitudinally extending air passages are substantially equal in cross-section and length, and terminate in outlet openings 138, 140 and 142 respectively. As previously indicated, three nozzles, air passages and outlet openings are disclosed for purposes of illustration only, and any desired number in excess of one can be used.

Three media inlet openings 144, 146 and 148 are formed in a portion of the flat surface 122 of the manifold 124 which is within the confines of the separator 116. These media inlet openings extend downwardly into communication with the longitudinally extending air passages 132, 134 and 136, respectively. Since no pressure differential exists between the interior of the separator unit 116 and the air passages within the manifold 124, abrasive material will pass by gravity through the inlet openings 144, 146 and 148 into the air passageways 132, 134 and 136. Since the media inlet openings are equal in size and the abrasive material is spread across the flat surface 122 of the manifold 124, substantially equal amounts of abrasive will pass into each longitudinally extending air passageway. Equal streams of compressed air are provided from the manifold chamber 130 to each of the longitudinally extending passageways, and these equal streams convey the abrasive out through the outlet air streams convey the abrasive out through the outlet openings 138, 140 and 142. Each of these outlet openings is connected to the inlet end of a nozzle 108 by a short conduit, as indicated at 150, 152 and 154. Thus, equal streams of air and abrasive are provided to each nozzle, and pass through the restriction 110 therein and out through the nozzle outlet 112. Once the abrasive from the nozzle outlets impinges on the surface 114, this abrasive and any dust and debris present is drawn back through the vacuum inlet slots 98 and 100 and into the forward and rear vacuum chambers 94 and 96. The abrasive, dust and other debris is then drawn through the branches 102 and 104 and out through the vacuum conduit 68.

INDUSTRIAL APPLICABILITY

The abrasive cleaning apparatus 10 employs a plurality of blast nozzles to direct an abrasive media in a stream of air under pressure against a surface to be cleaned. However, the surface may consist of vinyl, or other soft surfaces which can be damaged by conventional abrasive cleaning devices. The plurality of blast nozzles direct a pressurized flow of media in an even pattern on the surface to be cleaned, and spent media, dust and debris is drawn by vacuum away from the surface to a reclamation system where the media is separated for reuse from the air and debris.

We claim:

1. An abrasive cleaning device for cleaning a surface by directing streams of abrasive particles from a plurality of nozzles against the surface comprising a housing means defining an internal nozzle chamber having an open end, a plurality of nozzle means mounted within said housing means for directing streams of abrasive particles toward said open end of said nozzle chamber, particle divider means connected to said plurality of nozzle means, said particle divider means operating to receive a supply of pressurized air containing abrasive particles and to supply therefrom separate streams of pressurized air of substantially equal pressure and each containing substantially equal amounts of abrasive particles to said plurality of nozzle means whereby each of said nozzle means receives one of said separate streams, and supply means connected to said particle divider means for supplying pressurized air containing abrasive particles, said particle divider means including separator means for separating the abrasive particles from the pressurized air supplied by said supply means and manifold means connected to receive the separated pressurized air and abrasive particles from said separator means, said manifold means operating to provide separate streams of pressurized air of substantially equal pressure containing substantially equal amounts of abrasive particles, each said stream being provided to one of said nozzle means, 2. The abrasive cleaning device of claim 1, wherein said supply means includes a single supply conduit connected to supply a stream of pressurized air containing abrasive particles to said divider means.

3. The abrasive cleaning device of claim 1, wherein said separator means includes a closed cylinder having a top end, a bottom end, and a sidewall extending between said top and bottom ends, said supply means operating to provide pressurized air and abrasive particles to the top end of said cylinder and to direct a stream of pressurized air and abrasive particles against said sidewall in a manner to cause said particles to flow around said sidewall between the top and bottom ends thereof and separate from said pressurized air, and vent means extending from the top end of said cylinder to said manifold means to equalize the air pressure in said cylinder and manifold means.

4. The abrasive cleaning device of claim 3, wherein said supply means includes a single supply conduit connected to supply a stream of pressurized air containing abrasive particles to said closed cylinder.

5. The abrasive cleaning device of claim 4, wherein said manifold means includes a body having a top surface which extends across and closes the bottom end of said closed cylinder, said body having an internal manifold chamber connected to receive air from said vent means, a separate internal air passageway for each of said nozzle means extending from said manifold chamber through said body, and separate outlet openings in said body, each of said outlet openings providing an outlet for one of said internal air passageways.

6. The abrasive cleaning device of claim 5, wherein the top surface of said body includes at least one media input opening for each of said internal air passageways extending between said closed cylinder and a respective internal air passageway.

7. The abrasive cleaning device of claim 6, where said media input openings are equal in size and said internal air passageways are equal in cross-section and length.

8. The abrasive cleaning device of claim 7, which includes a plurality of nozzle conduit means extending between said manifold means and said nozzle means, one nozzle conduit means extending between each outlet opening in said body and one of said nozzle means.

9. An abrasive cleaning device for cleaning a surface by directing of abrasive particles from a plurality of nozzles against the surface comprising a housing means defining an internal nozzle chamber having an open end, a plurality of nozzle means mounted within said housing means for directing streams of abrasive particles toward said open end of said nozzle chamber, particle divider means connected to said plurality of nozzle means, said particle divider means operating to receive a supply of pressurized air containing abrasive particles and to supply therefrom separate streams of pressurized air of substantially equal pressure and each containing substantially equal amounts of abrasive particles to said plurality of nozzle means whereby each of said nozzle means receives one of said separate streams, supply means connected to said particles divider means for supplying pressurized air containing abrasive particles, and vacuum chamber means mounted within said housing means adjacent to but separated from said nozzle chamber, said vacuum chamber means having an open end adjacent to the open end of said nozzle chamber, and vacuum supply means connected to said vacuum chamber means to create a vacuum therein.

10. The abrasive cleaning device of claim 9, wherein said nozzle means are spaced inwardly from the open ends of said nozzle chamber and vacuum chamber means.

11. An abrasive cleaning device for cleaning a surface by directing streams of abrasive particles from a plurality of nozzles against the surface comprising particle stream source means for entraining abrasive particles in a stream of air under pressure, a portable nozzle carrier means for movement along a surface to be cleaned, a single supply conduit connected between said particle stream source means and said portable nozzle carrier means for supplying pressurized air containing abrasive particles from said particle stream source means to said portable nozzle carrier means, said portable nozzle carrier means including a housing means defining an internal nozzle chamber having an open end, a plurality of nozzle means mounted within said housing means for directing streams of abrasive particles toward the open end of said nozzle chamber and particle divider means mounted within said housing means and connected to said plurality of nozzle means, said particle divider means being connected to receive a supply of pressurized air containing abrasive particles from said supply conduit and to supply therefrom separate streams of pressurized air of substantially equal pressure and each containing substantially equal amounts of abrasive particles to said plurality of nozzle means whereby each of said nozzle means receives one of said separate streams.

12. An abrasive cleaning device for cleaning a surface by directing streams of abrasive particles from a plurality of nozzles against the surface comprising particle stream source means for entraining abrasive particles in a stream of air under pressure, a portable nozzle carrier means for movement along a surface to be cleaned, a supply conduit means connected between said particle stream source means and said portable nozzle carrier means for supplying pressurized air containing abrasive particles from said particle stream source means to said portable nozzle carrier means, said portable nozzle carrier means including a housing means defining an internal nozzle chamber having an open end, a plurality of nozzle means mounted within said housing means for directing streams of abrasive particles toward the open end of said nozzle chamber and particle divider means mounted within said housing means and connected to said plurality of nozzle means and connected to receive a supply of pressurized air containing abrasive particles, said particle divider means operating to separate said abrasive particles from the pressurized air received from said supply conduit means, to subsequently divide said separated pressurized air into a plurality of separate air streams and to then recombine a substantially equal amount of abrasive particles with each of said separate air streams to supply separate streams of pressurized air of substantially equal pressure and each containing substantially equal amounts of abrasive particles to said plurality of nozzle means whereby each of said nozzle means receives one of said separate streams.

13. An abrasive cleaning device for cleaning a surface by directing streams of abrasive particles from a plurality of nozzles against the surface comprising particle stream source means for entraining abrasive particles in a stream of air under pressure, a portable nozzle carrier means for movement along a surface to be cleaned, a supply conduit means connected between said particle stream source means and said portable nozzle carrier means for supplying pressurized air containing abrasive particles from said particle stream source means to said portable nozzle carrier means, said portable nozzle carrier means including a housing means defining an internal nozzle chamber having an open end, a plurality of nozzle means mounted within said housing means for directing streams of abrasive particles toward the open end of said nozzle chamber and particle divider means mounted within said housing means and connected to said plurality of nozzle means, said plastic divider means being connected to receive a supply of pressurized air containing abrasive particles from said supply conduit means and to supply therefrom separate streams of pressurized air of substantially equal pressure and each containing equal amounts of abrasive particles to said plurality of nozzle means whereby each of said nozzle means receives one of said separate streams, vacuum source means, abrasive particle reclamation means connected to said vacuum source means, said vacuum source means operating to create a vacuum in said abrasive particle reclamation means, and vacuum conduit means connected between said abrasive particle reclamation means and said portable nozzle carrier means.

14. The abrasive cleaning device of claim 13, wherein said portable nozzle carrier means includes vacuum chamber means mounted within said housing means, said vacuum conduit means being connected to said vacuum chamber means to create a vacuum therein, said vacuum chamber means operating to remove abrasive particles and debris from the surface to be cleaned and supply said particles and debris to said vacuum conduit means and said particle reclamation means.

15. The abrasive cleaning device of claim 14, wherein said abrasive particle reclamation means operates to separate abrasive particles from said debris and to collect said abrasive particles.

16. The abrasive cleaning device of claim 15, wherein said particle stream source means includes an abrasive particle supply means, a source of compressed air connected to said supply conduit means, and control means connected to supply abrasive particles from said abrasive particle supply means to said supply conduit means.

17. The abrasive cleaning device of claim 16, wherein said abrasive particle reclamation means is connected to said abrasive particle supply means, said source of compressed air is connected to said abrasive particle reclamation means, and an air control means is connected between said source of compressed air and said abrasive particle reclamation means, said air control means being selectively operable to supply air under pressure to said abrasive particle reclamation means to convey abrasive particles collected thereby to said abrasive particle supply means.

18. The abrasive cleaning device of claim 17, wherein said vacuum chamber means includes vacuum chambers mounted within said housing means on opposite sides of said nozzle chamber which are separated from said nozzle chamber, each said vacuum chamber having an open end adjacent to the open end of said nozzle chamber.

19. The abrasive cleaning device of claim 18, wherein said particle divider means includes separator means for separating the abrasive particles from the pressurized air supplied by said supply conduit means and manifold means connected to receive the separated pressurized air and abrasive particles from said separator means, said manifold means operating to provide separate streams of pressurized air of substantially equal pressure containing substantially equal amounts of abrasive particles, each said stream being provided to one of said nozzle means.

20. An abrasive cleaning device for cleaning a surface by directing abrasive particles under pressure against the surface comprising particle stream source means for entraining abrasive particles in a stream of air under pressure, said particle stream source means including abrasive particle supply means, a source of compressed air, air supply conduit means connected to said source of compressed air for conducting a stream of compressed air therefrom, and control means connected to supply abrasive particles from said abrasive particle supply means to said air supply conduit means, portable nozzle carrier means for movement along a surface to be cleaned, said portable nozzle carrier means being connected to said air supply conduit means and including nozzle means connected to direct abrasive particles supplied by said air supply conduit means against the surface to be cleaned, vacuum source means, abrasive particle reclamation means connected to said vacuum source means, said vacuum source means operating to create a vacuum in said abrasive particle reclamation means, vacuum conduit means connected between said abrasive particle reclamation means and said portable nozzle carrier means, said portable nozzle carrier means further including vacuum chamber means connected to said vacuum conduit means, said vacuum chamber means operating to remove abrasive particles and debris from the surface to be cleaned and to supply said abrasive particles and debris to said vacuum conduit means and said abrasive particle reclamation means, said abrasive particle reclamation means operating to separate abrasive particles from said debris and to collect said abrasive particles.

21. The abrasive cleaning device of claim 20, wherein said abrasive particle reclamation means is connected to said abrasive particle supply means, said source of compressed air is connected to said abrasive particle reclamation means, and an air control means is connected between said source of compressed air and said abrasive particle reclamation means, said air control means being selectively operable to supply air under pressure to said abrasive particle reclamation means to convey abrasive particles collected thereby to said abrasive particle supply means.

22. An abrasive cleaning device for cleaning a surface by directing streams of abrasive particles from a plurality of nozzles against the surface comprising a nozzle carrier means for movement along the surface to be cleaned, a plurality of nozzle means mounted on said nozzle carrier means for directing streams of abrasive particles toward said surface to be cleaned, a particle stream source means for entraining abrasive particles in a stream of air under pressure, particle divider means mounted on said nozzle carrier means and connected to said plurality of nozzle means, conduit means connected between said particle stream source means and said particle divider means for supplying a stream of air under pressure with said entrained particles to said particle divider means which operates to divide said stream of air under pressure with entrained particles into separate streams of pressurized air of substantially equal pressure each containing substantially equal amounts of abrasive particles, said particle divider means operating to provide one of said separate streams to each of said nozzle means whereby all such nozzles means operate to direct streams of abrasive particles of substantially equal amounts and under substantially equal pressure against said surface.

23. The abrasive cleaning device of claim 22 wherein said particle stream source means is spaced from and remote from said nozzle carrier means.

24. The abrasive cleaning device of claim 23 wherein said conduit means includes an elongate, flexible conduit.

* * * * *